US006923130B2

(12) United States Patent
Heckner et al.

(10) Patent No.: US 6,923,130 B2
(45) Date of Patent: Aug. 2, 2005

(54) SEWING MACHINE

(75) Inventors: Christoph Heckner, Bielefeld (DE); Markus Richter, Detmold (DE)

(73) Assignee: Dürkopp Adler Aktiengesellschaft, Bielefeld (DE)

( * ) Notice: Subject to any disclaimer, the term of this patent is extended or adjusted under 35 U.S.C. 154(b) by 19 days.

(21) Appl. No.: 10/501,572

(22) PCT Filed: Dec. 19, 2003

(86) PCT No.: PCT/EP03/14626

§ 371 (c)(1),
(2), (4) Date: Jul. 13, 2004

(87) PCT Pub. No.: WO2004/059064

PCT Pub. Date: Jul. 15, 2004

(65) Prior Publication Data

US 2005/0039657 A1 Feb. 24, 2005

(30) Foreign Application Priority Data

Dec. 28, 2002 (DE) ..... 102 61 339

(51) Int. Cl.[7] ..... D05B 57/14; D05B 57/26; D05B 57/36; D05B 69/00

(52) U.S. Cl. ..... 112/184; 112/231

(58) Field of Search ..... 112/181, 184, 112/197, 199, 231, 228, 229, 230

(56) References Cited

U.S. PATENT DOCUMENTS 4,572,091 A * 2/1986 Gustmann et al. ..... 112/229
4,669,401 A 6/1987 Dusch

FOREIGN PATENT DOCUMENTS

| | | |
|---|---|---|
| DE | 872148 | 2/1953 |
| DE | 100 25 852 | 11/2001 |
| DE | 100 25 851 | 2/2002 |

* cited by examiner

*Primary Examiner*—Peter Nerbun
(74) *Attorney, Agent, or Firm*—McGlew and Tuttle, P.C.

(57) ABSTRACT

A sewing machine with a hook (8) that is drivable in rotation about a vertical axis comprises a bobbin case (21) with a lifter cam (31). A case lifter (33) is provided, having a sensing lever (40) and a lifter lever (32) that bears against a lifter cam (28). The sensing lever rests on a cam face (42) of an axial cam disk (39) which is mounted on the transmission shaft that actuates a hook-driving shaft (10).

7 Claims, 2 Drawing Sheets

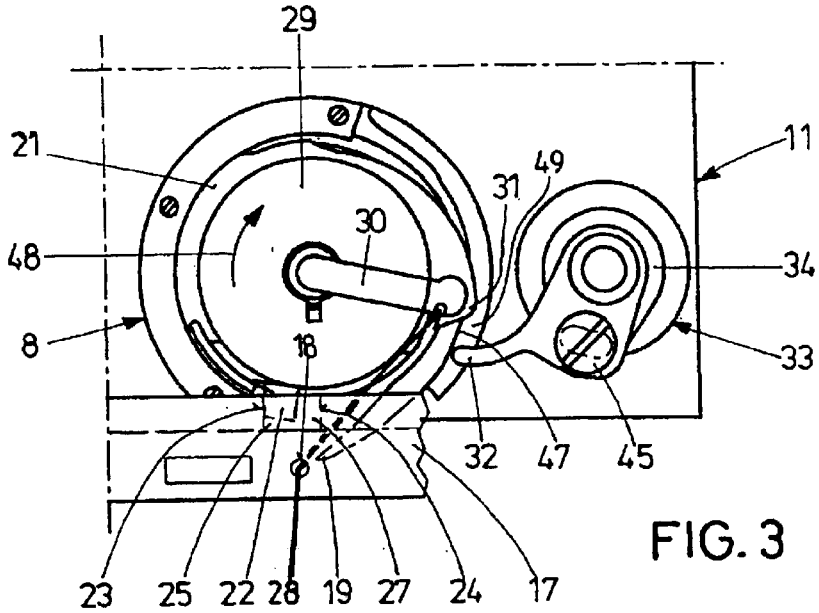
FIG. 3
FIG. 4
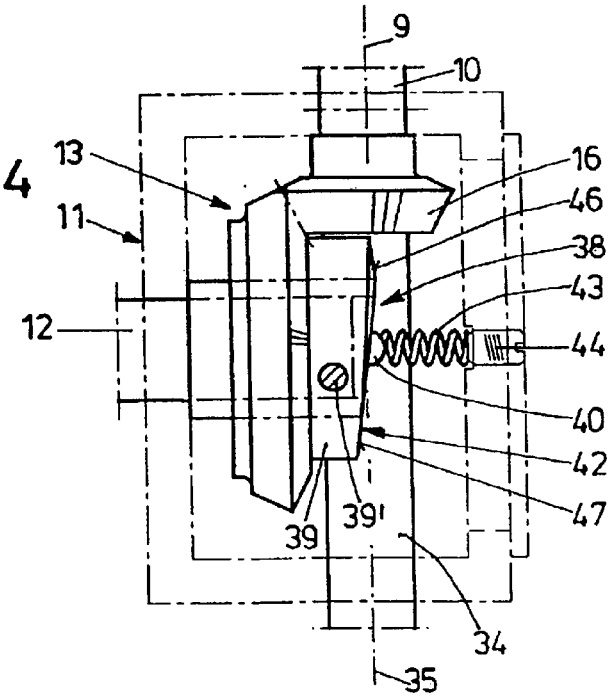
FIG. 5
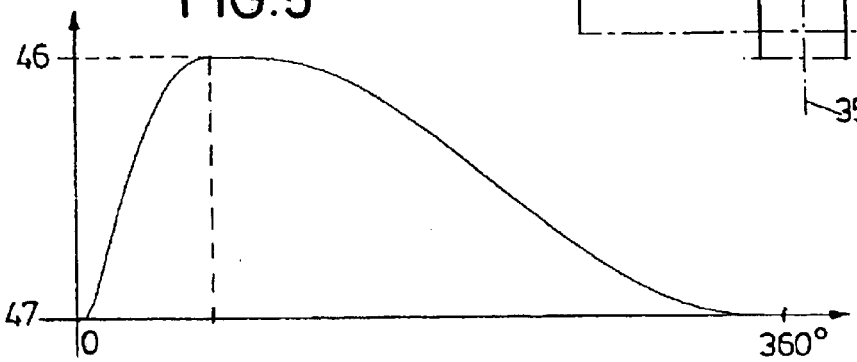

SEWING MACHINE

The invention relates to a sewing machine.

DE 100 25 851 C1 teaches a sewing machine of the generic type which includes an arm, a base plate and a needle which is mounted in the arm for up and down reciprocation, guiding a needle thread. It further comprises a hook which is lodged in a hook-bearing case in the base plate and rotatable by a vertical hook-driving shaft for rotation in a direction of rotation, and a drivable transmission shaft which is mounted in the base plate. A step-up gear transmission, which is disposed between the transmission shaft and the hook-driving shaft, is provided for actuation of the hook-driving shaft at twice the speed of the transmission shaft. A bobbin case is mounted in the hook for free rotation relative thereto; it houses a bobbin and is provided with a lifter cam and comprises a stopping rib which combines with a stopping cam that is stationary in relation to the base plate, preventing the bobbin case from rotating in the direction of rotation. A case lifter is provided, comprising a lifter lever that is applicable to the lifter cam and an operating lever joined thereto non-rotatably. Provision is made for a case-lifter drive mechanism which comprises a cam with circumferential cam face. This cam is driven by the hook-driving shaft via a reduction gear at half the speed of the hook. The operating lever bears against the circumferential cam face. The constructional requirements of this design are rather complicated because of the two gears.

German patent 872 148 teaches a retaining mechanism for a bobbin case. The hook-driving shaft of a hook that is rotatable about a vertical axis is driven via a step-up gear by a transmission shaft, actuation of which is derived from the sewing-machine drive mechanism. On the transmission shaft, provision is made for an eccentrically disposed cylinder as a cam, driving a lifter lever for the bobbin case by way of a spring-loaded lever. The sensing lever is pivoted in dependence on the position of the eccentrically arranged cylinder, releasing or retaining the bobbin case.

It is an object of the invention to embody a sewing machine of the generic type for the drive mechanism of the case lifter to operate based on especially simple and reliable means.

According to the invention, this object is attained by the features of claim 1. With case-lifter drive deriving directly from the front of the transmission shaft, actuation of the case lifter takes place directly at the correct speed, namely that of the transmission shaft which is only half the speed of the hook. This offers the possibility of a very compact structure. On the other hand it is not necessary that the hook is disposed directly above the gearing between the hook-driving shaft and transmission shaft. Furthermore, the number of structural components is low, reducing the cost of manufacture. The mass of movable parts is likewise insignificant. Since only a single gearing is necessary, transmission of the motion is substantially free from play.

Further advantages will become apparent from the subclaims.

Details of the invention will become apparent from the ensuing description of an exemplary embodiment, taken in conjunction with the drawing, in which FIG. 1 is a lateral longitudinal view of a two-thread lock-stitch sewing machine;

FIG. 3 is a plan view of the hook-bearing case with a case lifter in accordance with the arrow III of FIG. 1;

FIG. 4 is a side view of the cam disk of a case-lifter drive mechanism in accordance with the arrow IV of FIG. 2; and FIG. 5 is an illustration, in a coordinate system, of a development of the cam face of the cam disk.

Figure 1:
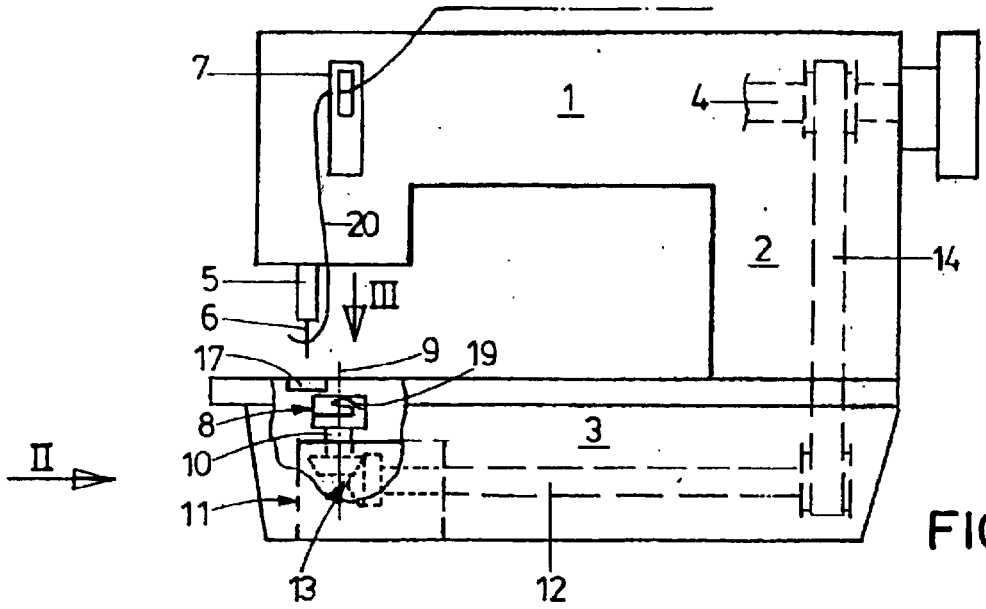

The two-thread lock-stitch sewing machine seen in FIG. 1 customarily comprises a top arm 1, a vertical standard 1 and a bottom base plate 3 of the type of a housing. An arm shaft 4 is mounted in the arm 1, with a needle bar 5, together with a needle 6, being drivable thereby in up and down reciprocation. The shaft 4 further actuates a thread lever 7.

The base plate 3 houses a vertical hook 8 which is a two-thread lock-stitch hook 8 driven in rotation about a vertical axis 9. A hook-driving shaft 10, which supports the hook 8 and is drivable about the axis 9, is rotatably lodged in a hook-bearing case 11 that is disposed in the base plate 3. It is driven by a transmission shaft 12 by means of a step-up gear 13. The transmission shaft 12 is driven by the arm shaft 4 by means of a synchronous belt drive 14. The synchronous belt drive 14 has a transmission ratio of 1:1. The step-up gear 13 is dimensioned for a transmission ratio of 1:2. This means that the hook 8 rotates twice when the arm shaft 4, respectively the transmission shaft 12, rotates once. For this to be put into practice, the driving bevel gear 15 that is mounted on the transmission shaft 12 has twice the number of teeth of the driven bevel gear 16 that is mounted on the hook-driving shaft 10.

A needle plate 17 with a stitch hole 18 is fixed above the hook 8 on the top side of the base plate 3. The cup-shaped hook 8 comprises a beak 19 which runs directly past the needle 6 when sunk into the stitch hole 18, seizing a needle thread 20 held thereby. A bobbin case 21 is lodged in the hook 8; it is freely rotatable about the axis 9 in relation to the hook 8. The bobbin case 21, which is also open upwards, comprises a stopping rib 22 of radially outward projection relative to the axis 9 and upward projection relative to the needle plate 17, the rib 22 being substantially non-rotatably retained between two stopping cams 23, 24 that are formed on the bottom side of the needle plate 17.

Figure 2:
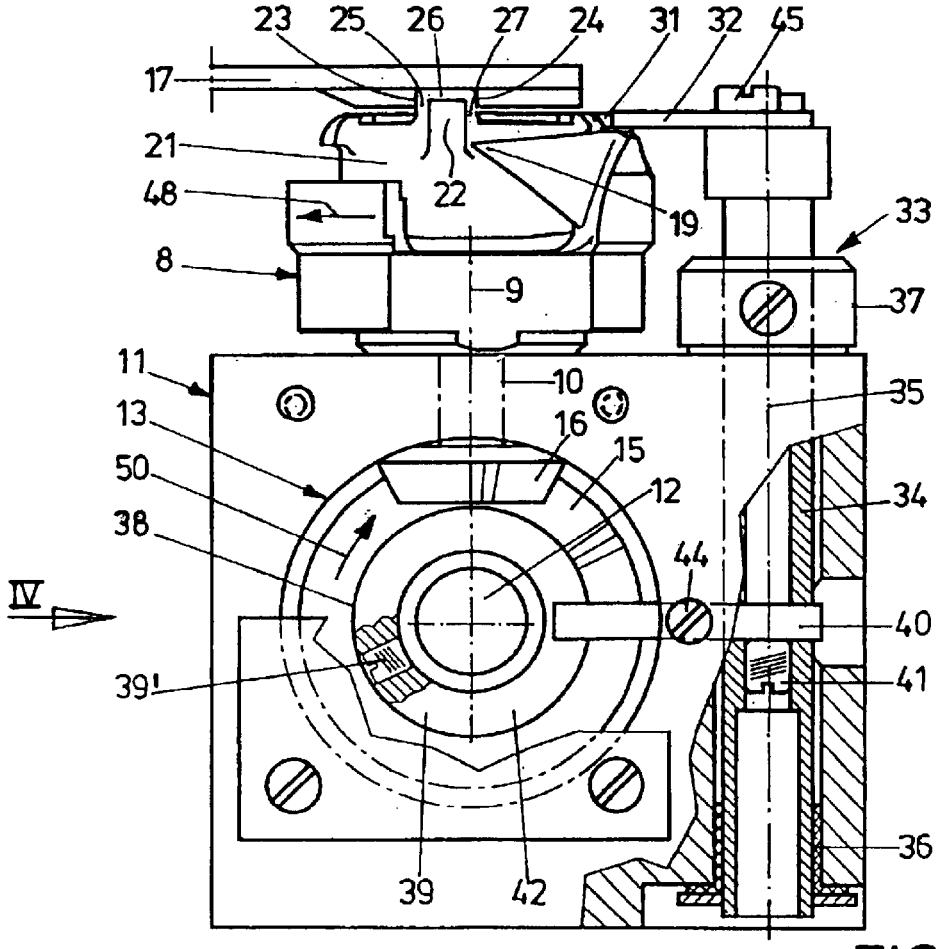
FIG. 2 is an elevation of the hook-bearing case of the sewing machine seen in the direction of the arrow II of FIG. 1.

As seen in particular in FIG. 2, a first lateral air gap 25 is located between the first stopping cam 23 and the stopping rib 22, a top air gap 26 is located between the stopping rib 22 and the needle plate 17, and a second lateral air gap 27 is located between the stopping rib 22 and the second stopping cam 24. In the central position of the stopping rib 22 seen in FIG. 2, the air gaps 25, 26, 27 constitute a continuous duct.

A bobbin 29, which holds an under-thread 28, is disposed in the bobbin case 21; it is retained in the bobbin case 21 by means of a releasable latch 30. On its top edge, the bobbin case 21 comprises a lifter cam 31 which stands out substantially radially of the axis 9 and cooperates with a lifter lever 32. The lifter lever 32 constitutes an arm of a case lifter 33. The case lifter 33 comprises a lifter shaft 34 which is mounted in the hook-bearing case 11 for rotation or pivoting motion in a bearing 36 about a vertical axis 35 that is parallel to the axis 9. The axial position of the shaft 34 relative to the hook-bearing case 11 is adjusted and fixed by a set collar 37.

The lifter shaft 34 is part of a case-lifter drive mechanism 38. This mechanism comprises an axial cam disk 39 which is mounted on the shaft 12 frontally upstream of the driving bevel gear 15 and adjustable by a set screw 39'; and a sensing lever 40 which bears against the axial can disk 39 and is non-rotatably joined to the lifter shaft 34. The sensing lever 40 in the form of a bolt is transversely inserted into the lifter shaft 34 and adjustably fixed by a set screw 41 which is disposed in the shaft 34. By its free end, the lever 40 bears against the frontal cam face 42 of the axial cam disk 39.

The sensing lever 40 is pressed against the cam face 42 by a pre-loaded helical compression spring 43. To this end, this compression spring 43 bears against the sensing lever 40 on the one hand and against an adjusting screw 44 on the other, the screw 44 being provided in the hook-bearing case 11. This screw 44 serves to set the pre-load of the compression spring 43 and thus the load by which the sensing lever 40 bears against the cam face 42.

The lifter lever 32 is joined to the lifter shaft 34 by means of a screwed connection 45 so that accurate adjustment of the case lifter 33 relative to the lifter cam 31 is possible. As seen from FIGS. 2, 3 and 4 in total, the compression spring 43 presses the lifter lever 32 in a direction towards the lifter cam 31, of course only to the extent allowed by the respective rotary position of the cam face 42.

As seen in FIG. 5, the cam face 42 is curved such that the sensing lever 40, and thus the lifter lever 32, make a harmonic motion upon revolution of the cam disk 39. At the highest elevation of the cam face 42—seen at the top in FIG. 4—the maximum lift 46 of the cam face 42 is reached as seen in FIG. 5. In this area, the lifter lever 32 is most remote from the lifter cam 31. In the lowermost area of the cam face 42—plotted at the bottom in FIG. 4—the minimum lift 47 of the cam face 42 is reached as seen in FIG. 5 i.e., in this area the lifter lever 32 rests on the lifter cam 31, moving the bobbin case 21 counter to the direction of rotation 48 of the hook.

If however—as mentioned—the lifter lever 32 lifts off the lifter cam 31, the bobbin case 21 is entrained in the direction of rotation 48 by the friction between the hook 8 and bobbin case 21 until the stopping rib 22 rests on the first stopping cam 23.

The fundamental mode of operation is the same as generally known for case lifters. When the lifter lever 32 does not rest on the lifter cam 31, then the stopping rib 22 of the bobbin case 21 bears against the first stopping cam 23 due to the fact that the bobbin case 21 is entrained by the hook 8 in the direction of rotation 48. In this case, the second lateral air gap 27 is enlarged as opposed to the illustration of FIG. 2, whereas the first lateral air gap 25 is closed. By the sensing lever 40 resting in the area of maximum lift 46 of the cam face 42, the lifter lever 32 is pivoted to such an extent that a gap 49 of 1 to 1.5 mm of width forms between the lifter cam 31 and the lifter lever 32. In the associated position of the hook 8 and the bobbin case 21, a thread loop that is formed by the needle thread 20 is taken by the beak 19. The under-thread 28 is guided via the latch 30 to the stitch hole 18. As the hook 8 rotates, the axial cam disk 39 and the cam face 42 make a rotary motion in the direction of rotation 50, with the speed of the axial cam disk 39 corresponding to only half the speed of the hook 8.

As the hook 8 continues rotating, the thread loop is slung around the stationary bobbin case 21, which is familiar and customary. Shortly before the loop is expanded maximally by the hook 8 i.e., prior to it being slung around the stationary bobbin case 19, the sensing lever 40 reaches the area of minimum lift 47 of the cam face 42. This starts a pivoting motion of the case lifter 33 counter to the direction of rotation 48 by the load of the compression spring 43. In the process, the bobbin case 21 is pivoted counter to the direction of rotation 48. The stopping rib 22 is lifted off the first stopping cam 23. In accordance with FIG. 2—the stopping rib 22 is moved approximately centrally between the two stopping cams 23 and 24 so that the first lateral air gap 25, the top air gap 26 and the second lateral air gap 27 are continuously open. The loop of the needle thread can slide unimpeded through the duct formed by the air gaps 25, 26, 27.

As the hook 8 continuous rotating, the loop of the needle thread is released. By continuing rotation of the cam face 42, the sensing lever 40 is pivoted in a direction towards the maximum lift 46 thereof; the gap 49 between the lifter lever 32 and the lifter cam 31 is again opened so that the thread loop can slide unimpeded through this gap 49, combining with the bobbin thread 28 to form a two-thread lock stitch.

What is claimed is:

1. A sewing machine, comprising an arm (1);

a base plate (3);

a needle (6), which is mounted in the arm (1) drivably in up and down reciprocation, for guidance of a needle thread (20);

a hook (8), which is mounted in a hook-bearing case (11) in the base plate (3), rotatable by a vertical hook-driving shaft (10) in a direction of rotation (48);

a transmission shaft (12), which is drivably lodged in the base plate (3);

a step-up gear (13), which is disposed between the transmission shaft (12) and the hook-driving shaft (10), for actuation of the hook-driving shaft (10) at twice the speed of the transmission shaft (12);

a bobbin case (21) housed in the hook (8) freely rotatably in relation thereto, wherein the bobbin case (21)

houses a bobbin (29), is provided with a lifter cam (31), has a stopping rib (22) which cooperates with a stopping cam (23) that is stationary relative to the base plate (3), preventing the bobbin case (21) from rotating in the direction of rotation (48);

a case lifter (33), which comprises a lifter lever (32) that is applicable to the lifter cam (31), a sensing lever (40) loaded by a spring (43), and a lifter shaft (34), which is pivotably mounted in the hook-bearing case (11), non-rotatably joining to each other the lifter lever (31) and the sensing lever (40); and a case-lifter drive mechanism (38), which comprises an axial cam disk (39), which is non-rotatably connected to the transmission shaft (12) and directly drivable thereby for rotation at a speed that is only half the speed of the hook (8), and which comprises a frontal cam face 42, against which is pressed the sensing lever (40).

2. A sewing machine according to claim 1, characterized in that the sensing lever (40) is fixed to the lifter shaft (34) adjustably in length.

3. A sewing machine according to claim 1, characterized in that the axial cam disk (39) is adjustably mounted on the transmission shaft (12).

4. A sewing machine according to claim 1, characterized in that the gear acting between the hook-driving shaft (10) and the transmission shaft (12) is a step-up gear (13); and in that the axial cam disk (39) is fixed to the transmission shaft (12) in the step-up gear (13).

5. A sewing machine according to claim 1, characterized in that the spring (43) loads the lifter lever (32) counter to the direction of rotation (48) of the hook (8).

6. A sewing machine according to claim 1, characterized in that the lifter lever (32) and the sensing lever (40) are joined to each other for adjustment one relative to the other.

7. A sewing machine according to claim 1, characterized in that the lifter lever (32) and the sensing lever (40) are joined to each other by a screwed connection (45).

* * * * *